US008991090B2

(12) United States Patent
Mizrachi

(10) Patent No.: US 8,991,090 B2
(45) Date of Patent: Mar. 31, 2015

(54) WEAPON FIRING SIMULATOR

(71) Applicant: Bagira Systems Ltd., Holon (IL)

(72) Inventor: Yaron Mizrachi, Tel Aviv (IL)

(73) Assignee: Bagira Systems Ltd., Holon (IL)

( * ) Notice: Subject to any disclaimer, the term of this patent is extended or adjusted under 35 U.S.C. 154(b) by 0 days.

(21) Appl. No.: 14/024,776

(22) Filed: Sep. 12, 2013

(65) Prior Publication Data

US 2014/0173964 A1 Jun. 26, 2014

(30) Foreign Application Priority Data

Dec. 23, 2012 (IL) ..... 223807

(51) Int. Cl.
*F41A 33/02* (2006.01)
*F41A 33/04* (2006.01)

(52) U.S. Cl.
CPC ..... *F41A 33/02* (2013.01); *F41A 33/04* (2013.01)
USPC ..... 42/90; 434/21

(58) Field of Classification Search
CPC ..... F41A 9/61
USPC ..... 434/23, 21, 16, 18, 24; 42/84, 90, 1.02
See application file for complete search history.

(56) References Cited

U.S. PATENT DOCUMENTS

| | | | | |
|---|---|---|---|---|
| 2,836,919 | A | 6/1958 | du Bois et al. | |
| 4,217,717 | A | 8/1980 | Canty et al. | |
| 4,416,631 | A | 11/1983 | Dawson et al. | |
| 4,521,195 | A * | 6/1985 | Moberg | 434/16 |
| 5,842,300 | A * | 12/1998 | Cheshelski et al. | 42/116 |
| 6,146,141 | A * | 11/2000 | Schumann | 434/11 |
| 6,869,532 | B2 * | 3/2005 | Arnold et al. | 210/500.25 |
| 8,770,978 | B2 * | 7/2014 | Botten | 434/16 |
| 8,827,706 | B2 * | 9/2014 | Hogan, Jr. | 434/18 |
| 2008/0108021 | A1 * | 5/2008 | Slayton et al. | 434/16 |

(Continued)

FOREIGN PATENT DOCUMENTS

| | | |
|---|---|---|
| KR | 20050017916 | 2/2005 |
| WO | 2008069560 | 6/2008 |
| WO | 2011043673 | 4/2011 |

OTHER PUBLICATIONS

EP13186830 Search Report of the European Patent Office, Dec. 6, 2013.

(Continued)

*Primary Examiner* — Reginald Tillman, Jr.
(74) *Attorney, Agent, or Firm* — Nathan & Associates Patent Agents Ltd.; Menachem Nathan

(57) ABSTRACT

A bullet-free training magazine designed to simulate real firing sounds and sights. The magazine is part of a magazine assembly which includes a magazine adaptor, a push to fire (PTF) trigger shaped to fit over a regular weapon trigger and to a fire flashlight. The PTF trigger and the fire flashlight are connected physically to the adaptor through two separate electrical cables. The magazine and the adaptor are coupled electrically through matching electrical interfaces and are designed for combined insertion into the magazine housing of a weapon. The magazine adaptor includes a first section adapted to attach to a magazine insertion member and including an adaptor electrical interface, a second section with two electrical sockets connected to the electrical cables, and a mounting adaptor member for mounting the magazine adaptor to fit into the magazine housing and into a firing chamber of the weapon.

14 Claims, 6 Drawing Sheets

(56) References Cited

U.S. PATENT DOCUMENTS

| | | | | |
|---|---|---|---|---|
| 2008/0127538 | A1 | 6/2008 | Barrett et al. | |
| 2008/0131848 | A1* | 6/2008 | Wilson et al. | 434/24 |
| 2010/0003643 | A1 | 1/2010 | Seo | |
| 2011/0000123 | A1 | 1/2011 | Taufman et al. | |
| 2012/0122058 | A1* | 5/2012 | Jensen et al. | 434/16 |
| 2012/0329364 | A1 | 12/2012 | Botten | |
| 2013/0337416 | A1* | 12/2013 | Guissin | 434/21 |
| 2014/0065577 | A1* | 3/2014 | Quinlan et al. | 434/18 |

OTHER PUBLICATIONS

Gresser, A., "AGDUS Handwaffen", Soldat Und Technik, Apr. 1, 1996, pp. 250-254, vol. 39, No. 4, Frankfurt, Germany.

* cited by examiner

WEAPON FIRING SIMULATOR

CROSS REFERENCE TO RELATED APPLICATIONS

This application claims the priority benefit of Israel patent application No. 223807 filed Dec. 23, 2012 and having the same title, which is incorporated herein by reference in its entirety.

FIELD

Embodiments disclosed herein relate in general to weapon training simulators and in particular to training (bullet-free) ammunition magazines which simulate real firing training conditions and which remove the need for use of live ammunition (bullets) in the training of military and other personnel.

BACKGROUND

Military training requires training of soldiers to fire weapons (e.g. guns) in various battle scenarios. Training with real live bullets is expensive and may be needlessly dangerous. The use of blank (dummy) bullets is also expensive and there is always the danger of mix-up with live bullets.

One known solution is the use of magazines which do not use bullets of any type. Such magazines are referred to henceforth as "training magazines", in contrast with normal, live ammunition containing magazines, which are referred to henceforth as "real magazines". In general, known training magazines resemble closely in shape real magazines and are inserted directly into the same magazine housing of a weapon. Instead of firing real bullets, such magazines are equipped with simulated firing means that provide sounds, light flashes, vibrations and other effects resembling a real firing environment. However, known training magazines suffer from a number of problems: the ability to fit in the same magazine housing as a real magazine carries the danger of substitution/mix-up with a real magazine, thereby endangering the user ("trainee") or others. A real bullet inserted (possibly erroneously) in the firing chamber of the weapon will not prevent the training magazine from being inserted into the magazine housing. In some known training magazines, the firing action includes use of the real weapon trigger to activate a lever integral to the training magazine body. This further increases the danger of unintended firing of a live bullet. Known training magazines also include mechanical parts which need to be changed and adapted for different weapons.

There is therefore a need for, and it would be advantageous to have, training magazines which do not suffer from the abovementioned problems.

SUMMARY

Embodiments disclosed herein teach training magazines and magazine assemblies which enable a full training experience by creating firing sounds of the weapon in hand, as well as a count of the shots fired. A training magazine assembly disclosed herein includes a magazine body shaped as a regular weapon magazine or as a drum magazine, a specially designed PTF (Push to Fire) trigger physically separate from the magazine body but coupled to the magazine body electrically by a first electrical cable; a firing sound effects electronic board; and a fire flashlight effect device mountable on a gun sight and coupled to the magazine body by a second electrical cable. The cables from the PTF trigger and the fire flashlight are physically connected to a magazine adaptor to which the magazine is attached mechanically and interfaced electrically. The magazine adaptor and the magazine are inserted together into the magazine housing of the weapon. The magazine adaptor is designed to prevent the use of a real magazine during the training exercise. The simulated magazine may create up to 135 dB firing sounds, according to the chosen weapon. The shot sounds are created by pulling the PTF trigger, thereby closely simulating a real firing action. The magazine enables countdown of the "shots" fired, after which the device stops making firing sounds. The number of shots can be determined by the user, according to the maximum bullet content of a real weapon. Fire flashlights may be synchronized with the firing sounds. The cabled connection of both the PTF trigger and the flashlight effect device enables training of magazine replacement during use, as in a real battle situation. The magazine can be connected to other types of out-door training devices and operate them using IR or sound transmitting\receiving means.

In an embodiment, there is provided a training magazine comprising a magazine body which includes an insertion ("shoulder") member having a first surface for mechanical attachment and electrical coupling to a magazine adaptor and a second surface for mechanical coupling to a weapon magazine housing, means for emitting a firing sound upon actuation by a PTF trigger, a counter for counting simulated bullets, and a reset device configured to add simulated bullets when the counter indicates a zero count. Optionally, the magazine further includes a dummy shoulder member for simulating a paired magazine structure. In some embodiments, the first surface includes a magazine electrical interface, and the electrical coupling to the magazine adaptor includes electrical coupling to an adaptor electrical interface.

In an embodiment, there is provided a training magazine assembly, comprising a bullet-free magazine designed to emit sounds upon actuation by a PTF trigger ergonomically structured to fit a regular weapon trigger, a magazine adaptor attached and electrically coupled to the magazine and adapted to fit together with the magazine into a magazine housing of the weapon, and a fire flashlight designed to emit a fire flash together with the emitted sound, wherein the PTF trigger and the fire flashlight are electrically coupled to the magazine through two separate electrically conductive cables connected to the magazine adaptor.

In an embodiment, the magazine includes a magazine body with an insertion member having a first surface for the mechanical attachment and electrical coupling to the magazine adaptor and a second surface for mechanical coupling to the magazine housing In an embodiment, the magazine adaptor includes a mounting adaptor member for mounting the magazine adaptor to fit into the magazine housing and into a firing chamber of the weapon.

In an embodiment, the magazine electrical coupling to the magazine adaptor is provided by a magazine electrical interface on the first surface.

In an embodiment, the magazine adaptor further includes a L-shaped adaptor member with a first section adapted to attach to the magazine insertion member, the first section including an adaptor electrical interface for electrical coupling to the magazine electrical interface.

In an embodiment, the first section includes a mechanical coupling feature for coupling to a matching feature on an internal wall of the magazine housing.

In an embodiment, the L-shaped adaptor member further includes a second section with two electrical sockets and wherein each of the two conductive cables is connected to a socket.

In an embodiment, the mounting adaptor member includes a cylindrical pin fixedly attached to a stand which is shaped to be slidingly engaged in a recess in the first section.

In an embodiment, the mounting adaptor member further includes a tubular spring inserted in the recess and used to secure the cylindrical pin in the firing chamber.

In an embodiment, the magazine body further includes a dummy shoulder member for simulating a paired magazine configuration.

BRIEF DESCRIPTION OF THE DRAWINGS

Non-limiting examples of embodiments disclosed herein are described below with reference to figures attached hereto that are listed following this paragraph. Identical structures, elements or parts that appear in more than one figure are generally labeled with a same numeral in all the figures in which they appear. The drawings and descriptions are meant to illuminate and clarify embodiments disclosed herein, and should not be considered limiting in any way.

DETAILED DESCRIPTION

Figure 1:
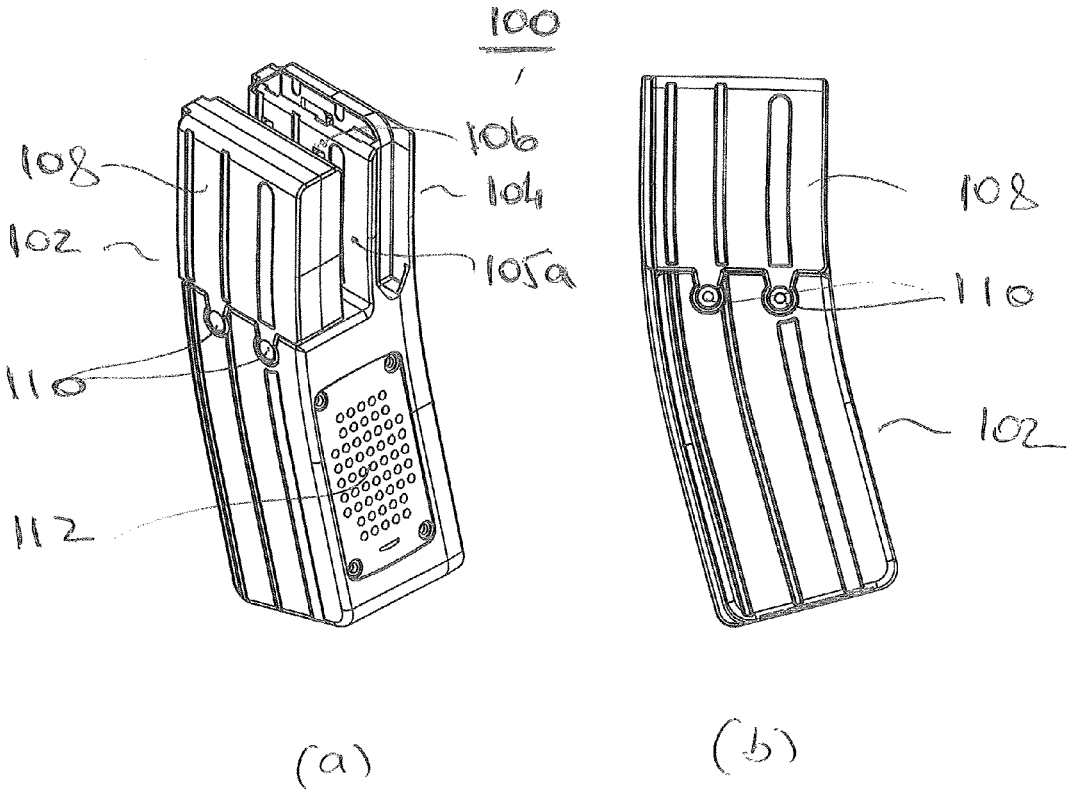
FIG. 1 shows an embodiment of a training magazine disclosed herein in various views: (a) frontal isomeric view and (b) back view.
Figure 2:
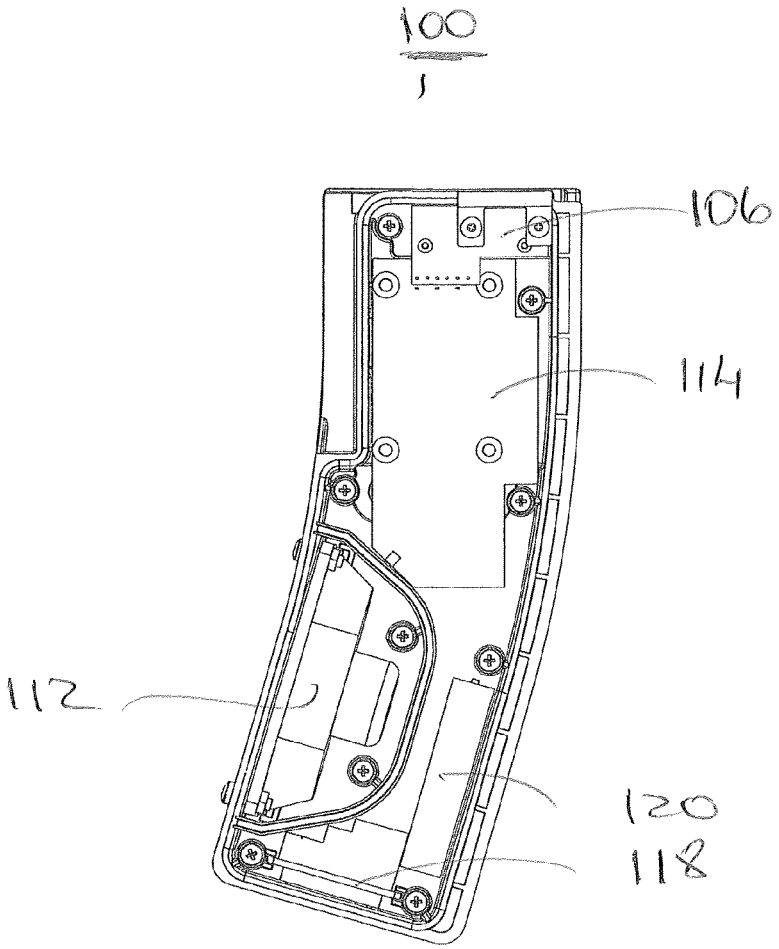
FIG. 2 shows the magazine of FIG. 1 in two more detailed views which show some internal components.
Figure 3:
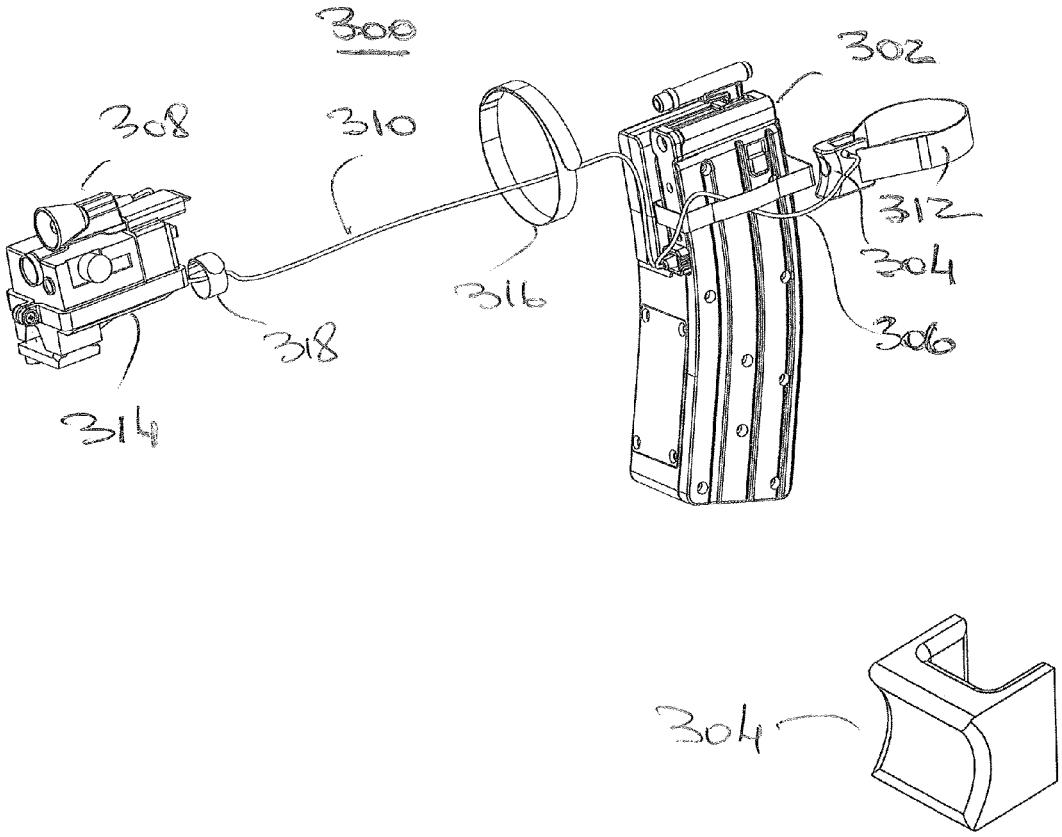
FIG. 3 shows a block diagram of a training magazine assembly disclosed herein.
Figure 4:
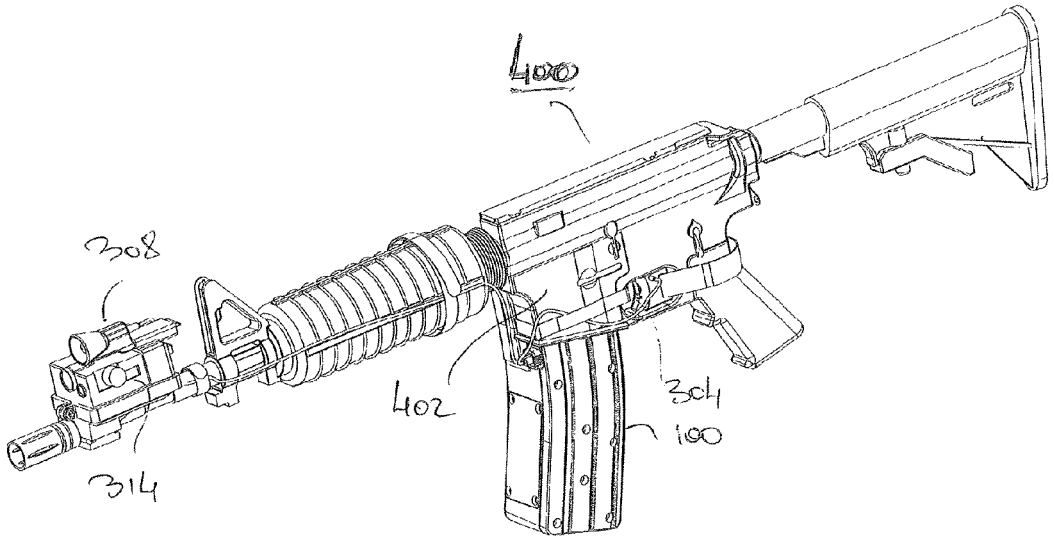
FIG. 4 shows a M4 rifle having the training magazine assembly of FIG. 3 attached thereto.
Figure 5:
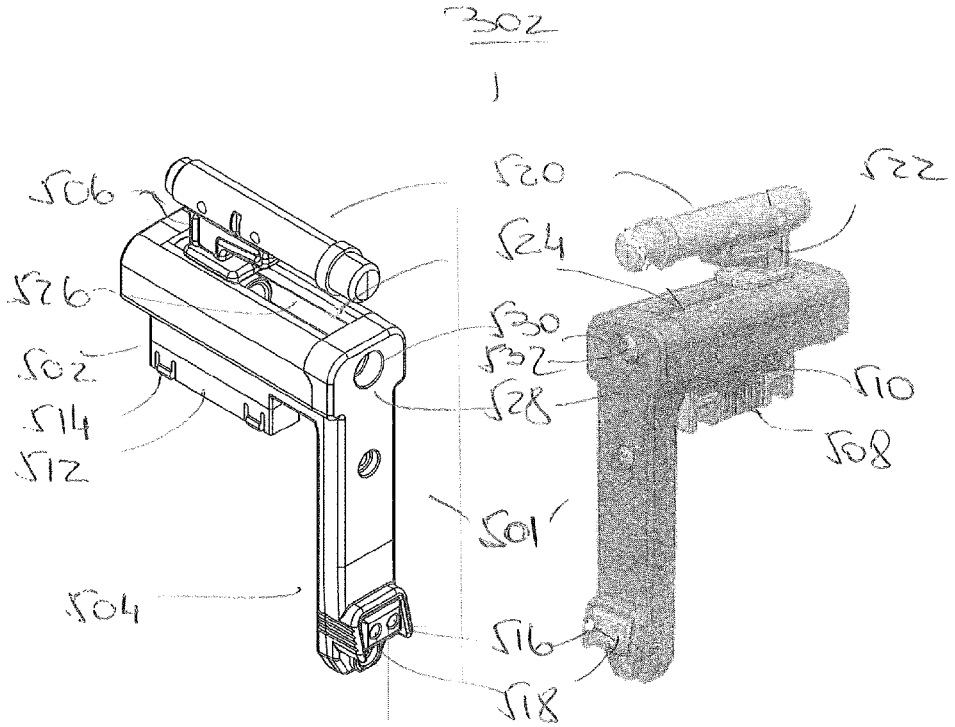
FIG. 5 shows details of the magazine adaptor.

Embodiments disclosed herein relate to training magazines. A training magazine disclosed herein may be used in a real gun such as M4, M16, M60, K1, K2, and K3 and operates when a PTF trigger adapted to fit the trigger of the weapon is actuated. FIG. 1 shows an embodiment of a "regular" training magazine disclosed herein and numbered 100 in (a) frontal isomeric view and (b) back view. FIG. 2 shows magazine 100 in a more detailed view, with some internal components visible to the viewer. FIG. 3 shows an embodiment of a training magazine assembly 300. Assembly 300 includes magazine 100, a magazine adaptor 302, a PTF trigger 304 electrically coupled to the magazine by a first electrically conducting cable 306 and a fire flashlight 308 electrically coupled to the magazine by a second electrically conducting cable 310. Trigger 304 is also shown separately and magnified in FIG. 3. FIG. 4 shows a weapon 400 (exemplarily a M4 rifle) having the training magazine assembly attached thereto, with the magazine inserted in an operationally ready mode in the weapon. FIG. 5 shows details of the magazine adaptor. The description follows with alternate reference to these drawings.

Magazine 100 includes a magazine body 102 generally shaped to resemble a real magazine, with an insertion member 104 being a part which is inserted a magazine receptor member (magazine housing) 402 of a weapon 400 (FIG. 4) together with magazine adaptor 302 (FIG. 5). Insertion member 104 has an internal surface 105*a* adapted to fit mechanically and connect electrically to a matching surface on the adaptor. In particular, internal surface 105*a* is adapted to provide a magazine electrical interface (electrical connector assembly) 106 which is electrically coupled to an adaptor electrical interface 508 (FIG. 5). A, "dummy" shoulder member 106 may optionally be added in some embodiments to the magazine body to simulate a "paired" (or "double") magazine configuration, i.e. the configuration of two real magazines attached to each other. This configuration is often used in real combat. The dummy shoulder member may be attached to the magazine body through a simple plug-socket mechanism 110 Thus, it can be attached by pressing it into, and detached by pulling it from, the magazine body. Magazine 100 further includes a speaker 112 (shown internally in FIG. 2), capable of outputting up to 135 dB firing sounds, a main electronic board 114 which includes all necessary components for processing, storage and wireless (e.g. RFID) communication as well as sound and light actuation (i.e. a sound card and a generator of signals to the flashlight), a bullet counter (not shown), a reset device 118, and a power source (e.g. a lithium battery) 120. Body 100 may be made of a material similar to or identical with that of a real magazine, e.g. a metal or reinforced plastic.

Focusing now on FIG. 3, PTF trigger 304 is a generally elastic or flexible member (made e.g. of rubber or similar material) ergonomically structured or shaped to fit (cover) the weapon trigger. PTF trigger 304 includes an electrical switch (not shown) coupled to cable 306. PTF trigger 304 may be held in close proximity to the weapon trigger by a first band 312 adapted to wrap around a weapon handle 404 (FIG. 4). Band 312 may be loosened or tightened around weapon handle 404 as to cause the switch to be electrically "open" unless pushed by a finger of the user, which "closes" it, thereby closing an electrical circuit which activates a simulated "firing" action. Other bands such as bands 316 and 318 may be used to secure cable 310 to the weapon. Fire flashlight 308 may include for example a LED or laser, or an infrared light. Light 308 may be attached by an adapter 314 to the weapon bore close to the front sights and aligned with the bore axis so that flashes emitted by it "hit" an intended target. An exemplary laser and adaptor system which may be used is a Laser Engagement System provided by Cubic Corporation.

Focusing now on FIG. 5, magazine adaptor 302 includes an L-shaped member 501 with a first section 502 and a second section 504 generally perpendicular to the first section, and a mounting adaptor member 506. First section 502 includes a top guiding rail (recess) 524 and is on one hand engageable in a magazine housing and on the other hand mechanically and electrically connectable to magazine 100. For the housing engagement, first section 502 includes an external surface 512 which is in mechanical contact with an internal wall (not shown) of magazine housing 402. At least one relief feature 514 is provided on surface 512 to mechanically couple to a matching feature (not shown) on the internal wall of magazine housing 402 (not shown). For the electrical connection to the magazine, first section 502 includes an adaptor electrical interface (e.g. an electrical connector board) 508 on a first (internal) surface 510. Second section 504 provides electrical connections between the magazine and the PTF trigger and fire flashlight. For this purpose, it includes a first electrical receptacle (socket) 516 and a second electrical socket 518. Cable 306 is coupled to first socket 516 while cable 310 is coupled to second electrical socket 518. Section 504 is in turn electrically coupled internally to electrical connector board 508 and through it to the magazine. Simulated weapon firing is effected when the switch in the PTF trigger closes an electrical circuit, activating sound and flashlight effects.

Mounting adaptor member 506 includes a cylindrical pin 520 fixedly attached to a stand 522, the stand shaped to be slidingly engaged in recess 524. A tubular spring 526 is inserted in the recess between a rear end of stand 522 and a rear wall 528 of second section 504. Rear wall 528 has a hole 530 with a diameter smaller than the diameter of spring 526, such that a hemispherical end 532 of spring 526 protrudes through the hole. The sliding movement of stand 522 in recess 524 compresses and releases tubular spring 526.

During insertion of the magazine and adaptor into the magazine housing, the L-shaped and mounting adaptor members are spring-loaded into, respectively, the weapon magazine housing and the firing chamber of the weapon. In the insertion process, hemispherical end 532 is in sliding contact with a section of an internal back surface (not shown) of the magazine housing. End 532 is slightly pushed into the recess, compressing the spring and moving the mounting member forward (in the direction of the weapon barrel) to enter the firing chamber. Once pin 520 is fully within the firing chamber, the pin and the mounting member move slightly backwards, locking mounting adaptor member 506 in the firing chamber.

When locked, member 506 blocks the chamber from receiving live bullets. The blockage is such that one cannot insert a bullet into the firing chamber even manually. The lateral dimensions of first section 502 are such that it narrows the opening in the weapon magazine housing, thereby preventing the insertion of a real magazine. Neither of these security features is available in known training magazines.

Figure 6:
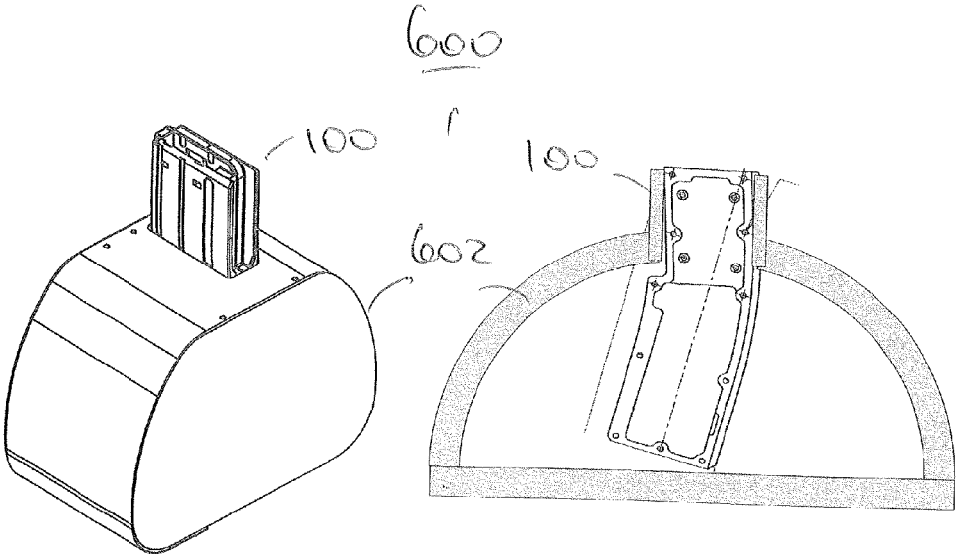
FIG. 6 shows an embodiment of another training magazine disclosed herein in various views.

FIG. 6 shows an embodiment 600 of a drum shaped training magazine disclosed herein in various views. Drum 600 is shaped to resemble a real drum shaped magazine and includes all the functionalities of magazine 100. It includes basically a regular training magazine such as magazine 100, surrounded by a drum shaped envelope 602.

Magazine 100 is adapted to perform functions and actions resembling those of a real magazine, i.e. provide sounds and light flashes closely resembling those occurring when the weapon fires real bullets. In use, the training magazine is inserted and removed from a weapon just like a real magazine, with the key difference that the magazine adaptor provides the added safety. The counter counts the number of shots fired and stops the firing after a predetermined number of shots (e.g. 29 in a regular training magazine), when the magazine is "empty". The reset device then restarts the firing sequence and can enable repeated firing up to a predetermined (e.g. 8) number of magazines being "fired". After firing of the maximum allowed number of magazines, the training may continue only with a restart of the training, which can be done wirelessly and remotely by commands relayed to the magazine. In an exemplary training session, each trainee is given a regular training magazine with 29 "bullets" or 150 "bullets" for a drum magazine. The regular training magazine is configured to fire single shots, while the drum magazine is configured to fire automatically 3 shots. Other configurations are of course possible by programming a central processor (not shown) in the main electronic board. The magazine adaptor is coupled mechanically to the magazine, and the adaptor and magazine are inserted into the magazine housing in the weapon, with the adaptor mounting adaptor member installed and locked inside the weapon firing chamber. As mentioned, this prevents absolutely a mistaken insertion of a "real" magazine into the weapon or the insertion of a live bullet into the firing chamber. The PTF trigger is arranged to fit over the weapon trigger and is cable connected electrically to the magazine, as is the flashlight assembly.

When the PTF trigger is actuated (pressed or pulled like the real trigger), the action is conveyed through the cable to the main electronic board. The bullet counter is checked to see if there are "bullets" in the magazine. If yes, a "shot" accompanied by sound of up to 135 dB and flashlight effects is "fired". If No (the counter indicates zero "bullets"), there is no shot. The trainee then needs to "change" the magazine, i.e. remove it from, and reinsert it into the weapon. The magazine is "loaded" with bullets up to its maximum capacity, and one magazine is "removed" from the maximum allowed number of magazines. This process continues until both magazines and bullets are "exhausted". The bullets and magazines can then be "replenished" remotely by commands relayed to the magazine from an external authority (e.g. a trainer). One way of doing this is by RFID means (not shown).

While this disclosure has been described in terms of certain embodiments and generally associated methods, alterations and permutations of the embodiments and methods will be apparent to those skilled in the art. The disclosure is to be understood as not limited by the specific embodiments described herein, but only by the scope of the appended claims.

The invention claimed is:

1. A training magazine assembly, comprising:
   a) a bullet-free magazine designed to emit sounds upon actuation by a push to fire (PTF) trigger ergonomically structured to fit a regular weapon trigger;
   b) a magazine adaptor attached and electrically coupled to the magazine and adapted to fit together with the magazine into a magazine housing of the weapon, wherein the magazine adaptor includes a mounting adaptor member for engaging the magazine adaptor into a firing chamber of the weapon and wherein the magazine includes a magazine body with an insertion member having a first surface for the mechanical attachment and electrical coupling to the magazine adaptor and a second surface for mechanical coupling to the magazine housing; and
   c) a fire flashlight designed to emit a fire flash together with the emitted sound, wherein the PTF trigger and the fire flashlight are electrically coupled to the magazine through two separate electrically conductive cables connected to the magazine adaptor.

2. The magazine assembly of claim 1, wherein the magazine electrical coupling to the magazine adaptor is provided by a magazine electrical interface on the first surface.

3. The magazine assembly of claim 2, wherein the magazine adaptor further includes a L-shaped adaptor member with a first section adapted to attach to the magazine insertion member, the first section including an adaptor electrical interface for electrical coupling to the magazine electrical interface.

4. The magazine assembly of claim 3, wherein the first section includes a mechanical coupling feature for coupling to a matching feature on an internal wall of the magazine housing.

5. The magazine assembly of claim 4, wherein the L-shaped adaptor member further includes a second section with two electrical sockets and wherein each of the two conductive cables is connected to a socket.

6. The magazine assembly of claim 5, wherein the mounting adaptor member includes a cylindrical pin fixedly attached to a stand which is shaped to be slidingly engaged in a recess in the first section.

7. The magazine assembly of claim 6, wherein the mounting adaptor member further includes a tubular spring inserted in the recess and used to secure the cylindrical pin in the firing chamber.

8. The magazine assembly of claim 1, wherein the magazine body further includes a dummy shoulder member for simulating a paired magazine structure.

9. The magazine assembly of claim 1, wherein the fire flashlight includes a laser.

10. The magazine assembly of claim 1, wherein the fire flashlight includes a LED.

11. A training magazine assembly, comprising:

a) a bullet-free magazine designed to emit sounds upon actuation by a push to fire (PTF) trigger ergonomically structured to fit a regular weapon trigger, the magazine including a magazine body with a magazine insertion member;

b) a fire flashlight designed to emit a fire flash together with the emitting of sound; and c) a magazine adaptor having a L-shaped adaptor member and a mounting adaptor member, wherein the L-shaped member includes a first section mountable into a weapon magazine housing in parallel with the magazine insertion member and a second section generally perpendicular to the first section and coupled electrically to the PTF trigger and the fire flashlight, and wherein the mounting adaptor member is mountable into a firing chamber of the weapon.

12. The magazine assembly of claim 11, wherein the magazine includes a counter for counting simulated bullets.

13. The magazine assembly of claim 12, further comprising a reset device configured to add simulated bullets when the counter indicates a zero count.

14. The magazine assembly of claim 11, wherein the fire flashlight includes a laser.

* * * * *